US005399274A

United States Patent [19]

Marcus

[11] Patent Number: 5,399,274

[45] Date of Patent: Mar. 21, 1995

[54] METAL WORKING LUBRICANT

[76] Inventor: R. Steven Marcus, P.O. Box 175, Amlin, Ohio 43002

[21] Appl. No.: 50,999

[22] Filed: Apr. 22, 1993

Related U.S. Application Data

[63] Continuation of Ser. No. 819,128, Jan. 10, 1992, abandoned.

[51] Int. Cl.[6] ..... C10M 173/02

[52] U.S. Cl. ..... 252/49.3; 252/49.8; 252/51.5 R; 252/49.6; 72/42

[58] Field of Search ..... 252/49.3; 72/42

[56] References Cited

U.S. PATENT DOCUMENTS

| | | | |
|---|---|---|---|
| 3,326,801 | 6/1967 | Schlobehm et al. | 252/51.5 |
| 3,896,038 | 7/1975 | Hartle | 252/51.5 A |
| 4,038,088 | 7/1977 | White et al. | 106/38.24 |
| 4,086,087 | 4/1978 | Morris | 75/200 |
| 4,101,346 | 7/1978 | Dorsey, Jr. | 148/6.27 |
| 4,405,471 | 9/1983 | Manson et al. | 252/34 |
| 4,452,712 | 6/1984 | Laemmle | 72/42 |
| 4,477,383 | 10/1984 | Beimesch et al. | 260/410.6 |
| 4,663,063 | 5/1987 | Davis | 252/51.5 R |
| 4,758,359 | 7/1988 | Kirk et al. | 252/49.3 |
| 4,761,241 | 8/1988 | Kobori et al. | 252/32.5 |
| 4,783,274 | 11/1988 | Jokinen et al. | 252/32.7 |
| 4,828,737 | 5/1989 | Sandberg et al. | 252/49.3 |
| 4,859,351 | 8/1989 | Awad | 252/32.5 |
| 4,906,394 | 3/1990 | Gutierrez et al. | 252/51.5 A |
| 4,925,582 | 5/1990 | Bennett | 72/42 |
| 5,084,195 | 1/1992 | Carmenzind et al. | 252/47.5 |

FOREIGN PATENT DOCUMENTS

| | | |
|---|---|---|
| 0228705A2 | 7/1987 | European Pat. Off. . |
| 0411202A1 | 2/1991 | European Pat. Off. . |

*Primary Examiner*—Ellen M. McAvoy

*Attorney, Agent, or Firm*—Burns, Doane, Swecker & Mathis

[57] ABSTRACT

A lubricant composition for use in metalworking processes comprising a fatty acid, an amino alcohol and a phosphate ester. Optional components include a triazole, an amine carboxylate, an amine borate or a vegetable oil. The composition may be used in dilute form in water or alcohol.

30 Claims, No Drawings

METAL WORKING LUBRICANT

This application is a continuation of application Ser. No. 07/819,128, filed Jan. 10, 1992, now abandoned.

FIELD OF THE INVENTION

The invention relates to a lubricant which is useful in metal working and metal forming processes. Specifically, the invention relates to a lubricant useful in sizing, coining and machining of powdered metal parts and/or conventional ferrous and non-ferrous metal parts.

BACKGROUND OF THE INVENTION

The manufacture of rolled metal parts requires primarily that ingots, bars or plates of steel or other metals, are roll formed through a succession of high pressure rollers, each reducing the base stock to a successively smaller cross-section until the desired dimension/shape is attained. These extreme pressure processes traditionally use large volumes of sulfonated/sulfated and/or chlorinated mineral oil or other mineral oil derivatives with extreme pressure additives to lubricate and cool the metal during the rolling process.

In the manufacturing of cast metal parts, the parts are cast from molten metal in foundry molds then machined to the desired shapes and dimensional tolerances. Lubricants are used to cool and lubricate the machine tools and the metal surfaces during the machining.

In the manufacture of powdered metal (sintered) parts it is frequently necessary to restrike or reform the parts after sintering in order to achieve specific dimensional tolerances desired or to compress the part to a desired higher density. This process is identified by various terms including "sizing", "re-striking", "coining", "burnishing" or "qualifying". Lubricants are used on the surface of the powdered metal parts in processing the parts before sintering and in sizing the parts after sintering. Lubricants are further used in machining and burnishing the parts.

Sizing requires the part to be placed in a steel or carbide die and squeezed under extremely high pressure to produce the specified dimensional and/or density requirements. This process requires extreme pressure boundary layer lubricants at the outset of the sizing stroke, followed by anti-weld lubricants as the heat and pressures tend to act to gall the workpiece and weld the exfoliative to the surfaces.

Typical lubricants are mineral oils and synthetic oils such as polybutenes, $\alpha$-olefins and polyethyleneglycols. These oils do not have strong polar groups and they are relatively low in lubricating ability. Accordingly, they cannot be used as a lubricant by themselves. Therefore, oiliness improvers, for example fats, saturated and unsaturated fatty acids, fatty acid esters, phosphates and alcohols are used to improve the lubrication properties of these oils. However, under extreme pressure applications, the oiliness improver is not effective and an extreme pressure additive such as sulfur, chlorine, phosphorus or lead is necessary. If chlorine is added and water is present during processing HCl is liberated causing serious corrosion problems. Furthermore, these oils are not suitable for making parts of higher densities with higher sizing pressures, because such oily lubricants tend to cause burning.

In the sizing process, a portion of the lubricant enters the pores of the powdered metal part, and other portions of the lubricant may be redeposited on the surface during ejection and handling. If the lubricant is an oil, excessive amounts entering the pores of the parts may prevent the part from compressing (a phenomenon known as hydraulicing) and may damage the dies.

U.S. Pat. No. 4,086,087 to Morris discusses the problem of oil in powdered metal parts and teaches that the pores be filled in a pretreatment step with an immiscible liquid, such as water, prior to contacting the metal part with the lubricant. The immiscible liquid is intended to prevent the oil lubricant from entering the pores, but excess water in the pores can also cause hydraulicing. It would be advantageous to have a lubricant which avoids this problem of oil based lubricants.

Because of the difficulty with oil lubricants, a common practice is to dry-coat the parts before sizing. The dry coating may be zinc-stearate, calcium carbonate or a similar dry lubricant which is suspended in a highly volatile carrier such as alcohol or trichloroethane. These lubricants are adequate in the dry form for medium pressure lubrication. In extreme pressure dry sizing, historically the lubricant has been a siloxane suspended in 1,1,1,-trichloroethane or a similar highly volatile solvent. The latter category of dry lubricant is generally considered the most successful to date for extreme pressure applications. Such dry lubricants are often supplemented with the addition of graphite powder. A significant problem of dry lubricants is that they have no cooling capacity.

In all cases the lubricant must also be compatible with subsequent operations. In the case of mineral oil based lubricants, and some dry lubricants, they generally must be removed before the part can be subjected to subsequent processing. This removal process may require burning off the lubricant in an oven at about 800° to 1000° F., or vapor degreasing the parts with chlorinated solvents, neither of which is desirable. The subsequent processes which necessitate the removal of the lubricants include, but are not limited to, heat treating, steam oxidizing, and resin impregnation.

Many powdered metal parts are subject to secondary operations which include but are not limited to drilling, tapping, honing, milling, broaching, lapping, and turning. Each of these operations may require a unique coolant or lubricant with different performance parameters capable of cooling the part and tools as well as providing corrosion control for the parts and equipment. For example, honing oils often require a high sulfur content; machining coolants might be semi-synthetic or synthetic lubricants; tapping lubricants require chlorinated oils. Each of these has its characteristic advantages and disadvantages.

A powdered metal parts manufacturer may have as many as a dozen different specialty purpose lubricants and rust inhibitors, each requiring special operator training and storage and disposal considerations. In view of the above, it would be advantageous if one lubricant could replace all of the oils, dry lubricants and coolants for these operations.

In addition to application problems with extreme pressure lubricants there are serious environmental problems with the use and disposal of solvents and oils. The products based on mineral oil cause oil smoke and oil mist in the work-room and air quality problems in and around the machines.

Although a water based lubricant generally dissipates from heat before total compression, an excess of fluid can cause hydraulicing. Moreover, if the lubricant is water based, it must have adequate corrosion control additives in order to survive the heat and pressure and still provide sufficient corrosion control until the parts are processed to the next operation.

Accordingly, there is a need to find an environmentally acceptable high performance metal working lubricant. The lubricant must demonstrate good lubricating and cooling ability at high surface pressures and/or good cutting and conversion velocities to give products the desired conformation, tolerance and surface finish, as well as decreased wear of the tools. Additionally, there is a need to find a metal working lubricant which can be used in a variety of the functions and processes of metal working, metal forming and metal finishing.

Accordingly, the present invention provides lubricant compositions that unexpectedly meet these stringent requirements. The compositions of this invention may also be used in many other applications such as conventional metal working, textile processing, paper processing and hydraulic systems.

SUMMARY OF THE INVENTION

The present invention is directed to a multi-purpose lubricant composition which is useful in metal working and metal forming processes. In one aspect, the lubricant composition comprises a combination of a fatty acid or mixtures of fatty acids neutralized with an amino alcohol and complexed with an organic phosphate ester.

In one of its compositional aspects, the present invention is directed to a lubricant composition wherein said lubricant contains at least about 9.5 percent organic phosphate esters by weight of the lubricant composition and at least about 1 percent by weight fatty acid neutralized with an amino alcohol.

In another aspect, the compositions of this invention can additionally comprise a water or alcohol solvent and/or a triazole, an amine carboxylate, an amine borate, a vegetable oil, a mineral oil, a synthetic ester, a polyalkyleneglycol and/or an animal oil.

In one of its method aspects, the present invention is directed to a method of treating metal parts wherein the part is first coated with a lubricant composition which contains a combination of a fatty acid or mixture of fatty acids neutralized with an amino alcohol and complexed with an organic phosphate ester and then worked to the desired shape.

DETAILED DESCRIPTION OF THE INVENTION

The present invention is directed to the discovery of a lubricant composition useful in metal working and metal forming processes. Basically, the lubricant comprises a fatty acid or mixtures of fatty acids neutralized with an amino alcohol and complexed with an organic phosphate ester.

The term "fatty acid" means a saturated or unsaturated fatty acid compound having the following formula R—COOH, where R is an alkyl group consisting of at least about 15 carbon atoms. Examples of such "fatty acids" are isostearic acid, stearic acid, isooleic acid, oleic acid, palmitic acid, isopalmitic acid and mixtures thereof. Other fatty acids are useful in this component of the composition. The fatty acid used in the invention can consist of one fatty acid or a combination of fatty acids.

The total amount of fatty acid generally employed in the lubricant composition is from about 1 weight percent to about 12 weight percent based on the total weight of the lubricant composition (including solvent). More preferably, the amount of the fatty acid component is between about 3 weight percent and about 8 weight percent, and most preferably is about 5 weight percent based on the weight of the lubricant composition. The specific concentration of the fatty acid in the lubricant composition is selected so as to provide a fatty acid concentration upon dilution of the lubricant composition in water or alcohol of at least about 0.02 weight percent.

It has been found that when the fatty acid component is neutralized with an amino acid in the presence of tap water that the lubricity of the lubricant composition is increased. Without being limited to any theory, it is believed that calcium stearate is formed by the reaction of the so-neutralized fatty acid with the calcium in the tap water, thus resulting in increased lubricity of the lubricant.

The term "amino alcohol" means an alcohol having at least one amino group. Preferably, the amino alcohol will contain between about 2 to 8 carbon atoms. More preferably, the amino alcohol will be a primary amino alcohol. The term "primary amino alcohol" means an alcohol with one amino group. Examples of primary amino alcohols include 2-amino-2-methyl-1-propanol, 2-amino-2-ethyl-1,3-propanediol and 2-amino-2-hydroxymethyl-1,3-propanediol. The term "neutralizing amount" means that amount of an amino alcohol employed in the lubricant which is sufficient to cause the pH of the lubricant to be at least about 8. Preferably, the amount will be that sufficient to achieve a pH in the range of about 8 to about 10. In general, the amount of the amino alcohol in the lubricant composition will be about 1 weight percent to about 10 weight percent and preferably about 5 weight percent, based on the total weight of the lubricant (including solvent). The specific concentration of the amino alcohol in the lubricant composition is selected so as to provide an amino alcohol concentration upon dilution of the lubricant composition in water or alcohol of at least about 0.02 weight percent.

It further has been found that phosphate esters act synergistically with the amino alcohol-neutralized fatty acids to yield increased lubrication properties of the composition. The term "phosphate esters" means an anionic surfactant comprising a diester or monoester having at least one phosphate group. In general the phosphate ester has the formula $OP(OR)_3$ where R may represent an aryl or alkyl group. Preferably, the phosphate ester is a compound having the formula

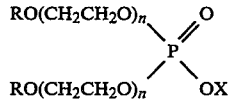

or

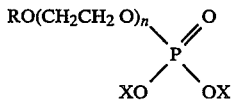

where R is any alkyl or alkylaryl group; n can equal from 1 to 10 and X is H, Na or K. The phosphate esters useful in the compositions of this invention can be organic esters of phosphinic or phosphonic acids or can be phosphoric esters of glycerols, glycols, and the like.

More preferably, the phosphate ester is Phosfac HR719 (Rhone-Poulenc, Cranbury, N.J.) or ACTAFOS 110A (Climax Performance Materials Corporation, Summit, Ill.).

The effective amount of phosphate esters in the lubricant composition is generally from about 8 weight percent to about 24 weight percent based on the weight of the lubricant (including solvent). Preferably, the amount of phosphate esters will be from about 15 weight percent to about 21 weight percent, and more preferably will be about 19 weight percent based on the total weight of the lubricant composition. The specific concentration of the phosphate esters in the lubricant composition is selected so as to provide a phosphate ester concentration upon dilution of the lubricant composition in water or alcohol of at least about 0.18 weight percent.

It has further been found that an appropriate solvent for the lubricant composition can be tap water or an alcohol. This range of solvents allows for increased flexibility in the use which can be made of the lubricant compositions. The term "alcohol" when referring to the solvent means a compound having the formula R—OH where R is a lower alkyl group, preferably comprising $CH_3$—, $CH_3CH_2$—, $CH_3(CH_2)_2$—, $(CH_3)_2CH_2$— and the like.

Preferably the amount of solvent in the lubricant composition will be between 20 and 85 weight percent based on the weight of the composition. More preferably, it will be between about 45 and 65 weight percent and most preferably between about 55 and 65 weight percent.

It has further been found that the addition of alkaline earth metal cations or ammonium ions improves the lubricity of the lubricant composition where the solvent or the diluent is water. Preferably such alkaline earth metal ions are Be, Mg, Ca, Sr, Ba and Ra. More preferably the earth metal ion is calcium. The source for the alkaline earth metal cation is preferably the oxide, halide or carbonate form of the cation. More preferably, the source of calcium is $CaCO_3$ or tap water. Most preferably, if the solvent or the diluent is tap water, the source is the calcium ion in the water.

The lubricant composition may also contain one or more of the following additives.

It has been found that the addition of amine carboxylates and amine borate esters to the lubricant composition results in inhibition of corrosion of the metal parts as well as further increasing the lubricity of the lubricant.

The term "amine carboxylate" means a carboxylic acid ester of the formula $X(CH_2)_nCOOR$ where n can equal from 2 to 10, X is $CH_3$— or ROOC— and R is an alkyl group having at least one amine group. The amine carboxylate is preferably high-melting, water soluble and odorless. Most preferably, the amine carboxylate is ACTRACOR 1987 (Climax Performance Materials Corporation, Summit, Ill.).

The term "amine borate esters" refers to compounds with the general formula $B(OR)_3$ where R is H, an alkyl group or an aryl group, wherein at least one R is an alkyl or aryl group containing at least one amine group. Preferably the R is an ethanolamine. Preferably the amine borate ester is monoethanolamine borate or triethanolamine borate, more preferably monoethanolamine borate. Most preferably, the amine borate ester is ACTRACOR M (Climax Performance Materials Corporation, Summit, Ill.).

It has further been determined that certain preferred ratios of amine carboxylate to amine borate ester in the lubricant composition can optimize the levels of rust inhibition and lubricity. In this application the term "carboxylate/borate ratio" refers to the ratio of carboxylate to borate which achieves an effective inhibition of rust and increased lubricity of the lubricant. Preferably, the carboxylate/borate ratio is from about 50:50 to 99:1. More preferably, the carboxylate/borate ratio is from about 60:40 to about 98:2 and most preferably from about 80:20 to about 95:5. A particularly preferred ratio is about 90:10.

The total amount of the amine carboxylate/amine borate ester mixture in the lubricant composition is preferably from about 3 weight percent to about 20 weight percent, more preferably from about 5 weight percent to about 9 weight percent based on the weight of the lubricant (including solvent). The specific concentration of the amine carboxylate/amine borate esters in the lubricant composition is selected so as to provide a concentration upon dilution of the lubricant composition in water or alcohol of at least about 0.06 weight percent.

The term "triazole" means a compound having an aromatic and triazole ring portion. Preferably, the triazole is a benzotriazole or a tolyltriazole or the sodium salts thereof as well as derivatives thereof which are compatible with the lubricant composition of this invention. More preferably the "triazole" is of the formula $C_6H_4N_3Na$, $C_6H_5N_3$ or $C_7H_7N_3$. Most preferably, the "triazole" is Cobratec 40S, Cobratec 99, Cobratec TT 50, or Cobratec TT 100 (PMC Specialities Group Inc., Cincinnati, Ohio). The total amount of triazole in the lubricant composition is preferably from about 0.02 weight percent to about 2 weight percent, more preferably from about 0.06 weight percent to about 0.15 weight percent based on the total weight of the lubricant (including solvent). The specific concentration of the triazole in the lubricant composition is selected so as to provide a concentration of triazole upon dilution of the lubricant composition in water or alcohol of at least about 0.001 weight percent.

It has further been found that the addition of vegetable oils or derivatives thereof to the lubricant composition of this invention further improves the boundary layer lubrication properties of the lubricant composition. The term "vegetable oils" refers to jojoba bean oil, soya bean oil, castor bean oil, corn oil, palm oil, rapeseed oil, and the like, as well as derivatives thereof which are compatible with the lubricant composition of this invention. A particularly preferred vegetable oil is rapeseed oil, especially a sulfated rapeseed oil due to its water solubility. The amount of vegetable oil in the lubricant composition is preferably from about 1 weight percent to about 19 weight percent based on the total weight of the lubricant composition (including solvent). Preferably, the amount of vegetable oil will be from about 1 weight percent to about 10 weight percent, and more preferably is about 2 weight percent based on the weight of the lubricant (including solvent). The specific concentration of vegetable oil in the lubricant composition is selected so as to provide a concentration upon dilution of the lubricant composition in water or alcohol of at least about 0.02 weight percent.

A preferred embodiment of the lubricant composition of this invention is tap water about 62.41 weight percent; aminomethylpropanol about 5.15 weight percent; fatty acid about 5.05 weight percent; benzotriazole about 0.16 weight percent; ACTRACOR 1987 amine carboxylate about 5.75 weight percent; ACTRACOR M amine borate about 0.6 weight percent; HR719 phosphate ester about 2 weight percent; ACTAFOS 110A phosphate ester about 16.88 weight percent and rapeseed oil about 2 weight percent.

The lubricating composition may also contain one or more other useful additives, such as anti-foam agents, emulsifiers, surfactants, fungicides, bactericides, and the like. The lubricating composition may also contain mineral oil, synthetic esters, polyalkyleneglycol adducts or animal oils.

The lubricant composition may be applied neat, in emulsion form or in water or alcohol solution or dilute solution to the metal or metal working machinery by flooding or spraying the parts and tooling or by dipping the parts prior to processing. When spraying the lubricant, either airless or air type sprayers may be used. When dipping the parts they are usually allowed to drain dry, and in some instances, are left to dry for as long as 36 hours. After processing, the residual lubricant is left on the parts to act as a short term corrosion inhibitor. The lubricant can be easily removed from the parts with any mild alkali or water wash.

The lubricant composition of this invention may be diluted to various concentrations with water or alcohol depending on the application. Referring to the preferred embodiment described above, some examples of the concentrations tried in different applications are: for sizing metal parts preferably at least about 5 percent in tap water, more preferably from at least about 10 percent in tap water; for thread tapping operations preferably at least about 5 percent and more preferably about 5 percent to about 10 percent in tap water; for drilling holes up to ½ inch diameter preferably at least about 2 percent, for larger holes preferably at least about 5 percent and more preferably about 5 percent to about 10 percent in tap water; for honing with diamond stones at least about 5 percent and more preferably from about 5 percent to about 10 percent in tap water; for light stamping of sheet metal preferably from at least 5 percent in tap water; for heavy banking of metal plate preferably at least about 25 percent in tap water; for metal rolling preferably at least about 25 percent tap water; as a rust inhibitor preferably at least about 5 percent in tap water.

In order to further illustrate the present invention and advantages thereof, the following specific examples are given, it being understood that the same are intended only as illustrative and in nowise limitative.

EXAMPLE 1: DRAWBEAD TEST OF LUBRICANTS

The laboratory process selected for these tests is known as a Drawbead Tester described in ASTM D-4173-82. This is an industry standard device for evaluating the relative lubricity of fluids and/or dry lubricants for drawing, stamping and rolling of metals. The device measures the pull strength required to pull a standard metal strip through a labyrinth created by three overlapping half-round dies. The dies are clamped together under controlled pressure with a force of 1000 pounds. Two strips are pulled through for each test. Prior to the first strip, both the strip and the dies are coated with the substance to be tested. Prior to the second strip, only the strip is coated. The second reading was selected as the comparative measurement since it in part measures the effect of residual matter left on the dies, and it is more comparable to actual production encounters. The test strips were cold-rolled steel with a thickness of 0.030 inches. Prior to testing, the thickness of each strip was measured with a rejection tolerance of 0.001 inches. Each strip was sanded on the edges to prevent any burr interference with the test reading.

The strip is pulled through the dies with a pulling force of up to 10,000 lbs, and for a distance of about 6 inches. The test deforms the strip into a "roller coaster" pattern. All samples were run in duplicate or triplicate and the average pull strength was compared. The less pull strength required, the better the lubrication value of the product. A difference of 1.0 is considered significant in these tests. The strips were also examined for scoring, stretching or tearing.

Water solutions of the following compositions were created as shown in Table I:

| | |
|---|---|
| FORMULA A: | |
| tap water | 82–84% |
| tolyltriazole (CobraTec TT 50: <2.0% PMC Specialties, Rocky River, OH) | |
| isostearic acid (CA 871: Chemical Associates, Cleveland, OH comprising 60–66 percent isostearic acid, 13–17 percent isooleic acid, 1–3 percent isopalmitic acid, 8–10 percent stearic acid and 6–12 percent oleic acid) | 7–84% |
| amine carboxylate (ACTRACOR 1987: Climax Performance Materials Corporation, Summit, IL) | 8% |
| amine borate (ACTRACOR M: Climax Performance Materials Corporation, Summit, IL) [neutralized to pH 8.0 with aminomethylpropanol (AMP95: Angus Chemical Company, Northbrook, IL)]. | 1% |
| FORMULA B: | |
| rapeseed oil (ACT 6092: Climax Performance Materials Corporation, Summit, IL) | 75% |
| jojoba bean oil (Sea-Land Chemical Co., Westlake, OH). | 25% |
| FORMULA C: | |
| tap water | 67% |
| alkylphenol ethoxylate (CO-630: Rhone-Poulenc, Cranbury, NJ) | 10% |
| tallamphopropionate (LM-SF: Rhone-Poulenc, Cranbury, NJ) | 10% |
| organic phosphate ester (RA-600: Rhone-Poulenc, Cranbury, NJ) | 8% |
| EDTA (Versene 100 XL: Dow Chemical, Midland, MI) | 2% |
| aminomethylpropanol (AMP95) | 3% |
| FORMULA D: | |
| tap water | 74% |
| isostearic acid (CA 871) | 5% |
| rapeseed oil (ACT 6092) | 16.5% |
| aminomethylpropanol (AMP95) | 4.5% |
| FORMULA E: | |
| tap water | 62% |
| aninomethylpropanol (AMP95) | 6% |
| isostearic acid (CA 871) | 6% |
| amine carboxylate (ACTRACOR 1987) | 6% |
| amine borate (ACTRACOR M) | 1% |
| organic phosphate esters (HR719: Rhone-Poulenc, Cranbury, NJ and ACTAFOS 110A: Climax Performance Materials Corporation, Summit, IL in weight ratio of 8.5:1) | 19% |
| FORMULA F: | |
| tap water | 62.41% |
| aninomethylpropanol (AMP95) | 5.15% |
| isostearic acid (CA 871) | 5.05% |
| benzotriazole (COBRATEC 40S, PMC Specialties, Rocky River, OH) | 0.16% |
| amine carboxylate (ACTRACOR 1987) | 5.75% |

-continued

| | |
|---|---|
| amine borate (ACTRACOR M) | 0.6% |
| phosphate ester (HR719) | 2% |
| phosphate ester (ACTAFOS 110A) | 16.88% |
| rapeseed oil (ACT 6092) | 2% |

The results of testing the above compositions in the Drawbead Test are as shown in Table I.

TABLE I

| SAMPLE | FORMULA | CONCENTRATION IN $H_2O$ | DRAWBEAD SECOND PULL |
|---|---|---|---|
| 1 | A | Neat | 17.51 |
| 2 | A | 10% | 23.12 |
| 3 | B | 10% | 19.84 |
| 4 | C | 10% | 23.74 |
| 5 | D | 10% | 23.51 |
| 6 | E | Neat | 11.17 |
| 7 | E | 75% | 12.62 |
| 8 | E | 50% | 13.57 |
| 9 | E | 10% | 17.96 |
| 10 | E | 5% | 20.37 |
| 11 | E | 2% | 22.21 |
| 12 | F | Neat | 9.99 |
| 13 | F | 10% | 14.67 |
| 14 | F | 2% | 20.14 |

EXAMPLE 2: COMMERCIALLY AVAILABLE LUBRICANTS

Having proven the advantages of the combined ingredients as illustrated in Example I, Formula F was compared to commercially available lubricants, coolants, rolling and forming compounds representative of the four basic categories: oils, soluble oils, semi-synthetics and synthetic lubricants.

This test used the same method, the Drawbead Tester, as described in Example I, and the same test conditions were employed as in the tests of Example I.

The following lubricants were tested:

FORMULA G: Dow 557 in a 1,1,1-Trichloroethane solvent base (Dow Chemical Corporation, Midland, Mich.)

FORMULA H: Calcium carbonate 5% (Van Waters & Roger, Inc., Seattle, Wash.); Oleic acid 7.5% (Monolube 110: Mona Industries, Paterson, N.J.) and tap water 87.5%.

FORMULA I: Naphthenic oil 200 sec (Calumet Manufacturing, Calumet, Ind.)

FORMULA J: Lubecon I/M (Lubecon Maintenance Systems, Fremont, Mich.) mineral oil 83.5%; fatty esters 7.5%; corrosion inhibitors 4%; unidentified colloidal suspension agents 5%.

FORMULA K: Zeller EP-30 mineral oil (Interchem Company, Richmond, Va.)

FORMULA L: Draw 44 (Lubricant Specialists, Inc., St. Paul, Minn.) (a soluble oil for heavy banking, rolling, drawing and stamping).

FORMULA M: Keil Draw II (Keil Chemical Company, Hammond, Ind.) (a semi-synthetic lubricant for drawing, stamping, and rolling metal)

FORMULA N: Morkool #51 (The Markee Corporation, Columbus, Ohio) (synthetic machining fluid based on polyalkylene glycols)

FORMULA O: Solvite 365A (Solvite Chemical Company, Aurora, Ohio) (synthetic sizing/drawing lubricant)

TABLE II

| SAMPLE | FORMULA | CONCENTRATION IN $H_2O$ | DRAWBEAD SECOND PULL |
|---|---|---|---|
| 15 | G | DRY | 9.86 |
| 16 | H | DRY | 17.15 |
| 17 | I | NEAT | 12.27 |
| 18 | J | NEAT | 20.29 |
| 19 | K | NEAT | 15.70 |
| 20 | L | NEAT | 5.55 |
| 21 | L | 50% | 16.28 |
| 22 | L | 25% | 15.05 |
| 23 | M | NEAT | 16.55 |
| 24 | M | 10% | 20.48 |
| 25 | M | 5% | 22.97 |
| 26 | N | NEAT | 18.27 |
| 27 | O | NEAT | 15.00 |
| 28 | O | 10% | 23.57 |
| 29 | O | 5% | 24.28 |

EXAMPLE III FIELD TESTS

Formulas E and F were tested in production runs for evaluation of the formulas under typical metal working conditions.

Case 1: Sizing of High Density Powdered Steel Parts. 105 pieces of high density powdered steel parts were sized to compare with production parts sized using DOW 557 (Formula G). The parts were hand dipped individually prior to machining. Formula F was found to perform better than Formula G, especially with regard to cleanliness of parts and temperature. After 3 days, Formula F processed parts did not contain any rust whereas Formula G processed parts were rusted.

Case 2: Sizing of Stainless Steel Powdered Metal Parts. The parts were dipped in the lubricant and sized. The number of parts which could be processed on one set of dies with Vydax (DuPont Company, Wilmington, Del.) mixed in Freon was 3000 to 5000. The number of parts which could be processed on one set of dies with Formula F diluted to 75% in water was 12,000.

Case 3: Honing of powdered iron parts with diamond honing stone. Formula F diluted to 10% in water was compared to Sunnen oil (Sunnen Products Company, St. Louis, Mo.) neat or Morkool #51 machining coolant (Formula N) neat. It was found that Formula F resulted in cleaner parts for less product used and less cost. Further it was found that there was less odor produced and less handling problems.

Case 4: Tapping of powdered iron parts: Formula E diluted to 10% concentration in water was compared to Trim VX (Master Chemical Co.) diluted to 17% in water. It was found that Formula E increased the tap life by approximately 80%. In general the tap life with Trim VX was approximately 1200 parts. It was found that the tap life of Formula E was approximately 10,000 parts.

While the invention has been described in terms of various preferred embodiments, the skilled artisan will appreciate that various modifications, substitutions, omissions and changes may be made without departing from the scope thereof. Accordingly, it is intended that the scope of the present invention be limited solely by the scope of the following claims, including equivalents thereof.

What is claimed is:

1. A lubricant composition comprising a fatty acid, an amino alcohol, an amine carboxylate, an amine borate ester and an effective complexing amount of a phosphate ester.

2. The lubricant composition of claim 1 wherein the fatty acid component of the composition comprises stearic acid, isostearic acid, oleic acid, isooleic acid, palmitic acid or isopalmitic acid.

3. The lubricant composition of claim 1 wherein said fatty acid component of the composition comprises isostearic acid and isooleic acid.

4. The lubricant composition of claim 1 wherein said fatty acid component is in the amount of about 3 to about 8 weight percent based on the total weight of the composition.

5. The lubricant composition of claim 1 wherein the phosphate ester component comprises the formula $OP(OR)_3$ where R comprises an aryl or alkyl group.

6. The lubricant composition of claim 5 wherein the phosphate ester component is in the amount of about 15 to about 21 weight percent based on the total weight of the composition.

7. The lubricant composition of claim 1 wherein said lubricant further comprises a triazole.

8. The lubricant composition of claim 1 wherein the weight ratio of amine carboxylate to amine borate ester in said lubricant composition is between about 80:20 and about 95:5.

9. The lubricant composition of claim 1 wherein said lubricant further comprises a vegetable oil.

10. The lubricant composition of claim 9 wherein the vegetable oil component comprises rapeseed oil.

11. The lubricant composition of claim 1 further comprising a source of alkaline earth metal cations.

12. The lubricant composition of claim 11 wherein said alkaline earth metal cation comprises a calcium cation.

13. The lubricant composition of claim 1 further comprising water.

14. The lubricant composition of claim 1 further comprising an alcohol.

15. The lubricant composition of claim 1 further comprising a source of alkaline earth metal cations or ammonium ions, water in the amount of about 45 to about 65 weight percent and the components comprise about 35 to about 55 weight percent of the composition.

16. A method of treating a metal part comprising contacting the metal part with a solution comprising at least about 2 percent of the lubricant composition of claim 15 and working the metal part to a desired shape.

17. The lubricant composition of claim 1 further comprising an alcohol in the amount of about 45 to about 65 weight percent and the components comprise about 35 to about 55 weight percent of the composition.

18. A method of treating a metal part comprising contacting the metal part with a solution comprising at least about 2 percent of the lubricant composition of claim 17 and working the metal part to a desired shape.

19. The lubricant composition of claim 1 further comprising mineral oil, a synthetic ester, a polyalkyleneglycol adduct or an animal oil.

20. A method of treating a metal part comprising contacting the metal part with a solution comprising at least about 2 percent of the lubricant composition of claim 1 and working the metal part to a desired shape.

21. The lubricant composition of claim 1 wherein the amino alcohol is a present in an effective neutralizing amount.

22. The lubricant composition of claim 21 wherein said amino alcohol component of the composition comprises 2-amino-2-methyl-1-propanol, 2-amino-2-ethyl-1,3-propanediol or 2-amino-2-hydroxymethyl-1,3-propanediol.

23. The lubricant composition of claim 22 wherein the amino alcohol component comprises 2-amino-2-methyl-1-propanol.

24. The lubricant composition of claim 23 wherein the amino alcohol component is in the amount of about 1 to about 10 weight percent based on the total weight of the composition.

25. A lubricant composition comprising the following components solubilized in a solvent:

| Component | Weight Percent |
|---|---|
| solvent | about 62.2% |
| aminomethylpropanol | about 5% |
| a fatty acid mixture | about 5% |
| benzotriazole | about 0.2% |
| an amine carboxylate | about 6% |
| an amine borate ester | about 0.6% |
| a phosphate ester | about 19% |
| rapeseed oil | about 2% |

wherein the fatty acid mixture comprises isostearic acid.

26. The lubricant composition of claim 25 wherein the solvent comprises water.

27. A method of treating a metal part comprising contacting the metal part with a solution comprising at least about 2 percent of the lubricant composition of claim 26 and working the metal part to a desired shape.

28. The lubricant composition of claim 25 wherein the solvent comprises an alcohol.

29. The lubricant composition of claim 25 further comprising mineral oil, a synthetic ester, a polyalkyleneglycol adduct or an animal oil.

30. A method of treating a metal part comprising contacting the metal part with a solution comprising at least about 2 percent of the lubricant composition of claim 28 and working the metal part to a desired shape.

* * * * *